US005850185A

United States Patent [19]

Canty

[11] Patent Number: 5,850,185

[45] **Date of Patent: *Dec. 15, 1998**

[54] DEFLECTION MONITORING SYSTEM

[76] Inventor: Jeffery N. Canty, P.O. Box 688, Mattapoisett, Mass. 02739

[ * ] Notice: The term of this patent shall not extend beyond the expiration date of Pat. No. 5,404,132.

[21] Appl. No.: 630,424

[22] Filed: Apr. 3, 1996

[51] Int. Cl.[6] ..... G08B 21/00

[52] U.S. Cl. ..... 340/686; 340/540; 340/666; 250/222.1; 52/741.3

[58] Field of Search ..... 340/690, 540, 340/686, 660; 250/222.1, 224; 52/741.3

[56] References Cited

U.S. PATENT DOCUMENTS

| | | | |
|---|---|---|---|
| 3,335,285 | 8/1967 | Gally, Jr. et al. | 250/221 |
| 3,711,846 | 1/1973 | Schlisser et al. | 340/258 |
| 4,136,556 | 1/1979 | Graham | 340/690 |
| 4,271,407 | 6/1981 | Kehrman et al. | 340/690 |
| 4,429,496 | 2/1984 | Masri | 52/1 |
| 4,581,712 | 4/1986 | Perry et al. | 364/558 |
| 4,843,372 | 6/1989 | Savino | 340/540 |
| 4,889,997 | 12/1989 | Tomiolo | 250/561 |
| 4,927,232 | 5/1990 | Griffiths | 250/227.24 |
| 4,936,060 | 6/1990 | Gelinas | 52/1 |
| 4,956,947 | 9/1990 | Middleton | 52/1 |
| 4,964,246 | 10/1990 | Kobori | 52/1 |
| 5,404,132 | 4/1995 | Canty et al. | 340/686 |
| 5,423,638 | 6/1995 | Merriman | 405/292 |
| 5,542,788 | 8/1996 | Stankus et al. | 405/288 |

FOREIGN PATENT DOCUMENTS 377880 7/1990 European Pat. Off. .

*Primary Examiner*—Jeffery A. Hofsass
*Assistant Examiner*—Benjamin C. Lee
*Attorney, Agent, or Firm*—Hale and Dorr LLP

[57] ABSTRACT

Deflections in supporting structures, due to external stress factors, can be detected with one or more energy beams generated along a path adjacent to the structure. Receivers are positioned in or near the path. Target blocks are positioned along the support structure. When a deflection occurs in the support structure, the targets are concurrently displaced into or out of the path. The receiver registers a change in state and activates an alarm. Multiple beams can be used to detect deflection in one of a number of predefined zones, the alarm indicating the zone in which the beam path was broken by the deflection.

20 Claims, 5 Drawing Sheets

DEFLECTION MONITORING SYSTEM

FIELD OF THE INVENTION

The present invention relates to a system for detecting deflections in a roof structure.

BACKGROUND OF THE INVENTION

As weight accumulates on a roof, especially a large flat roof, that weight deflects the roof's supporting structure. Stress from this weight may eventually cause the roof to collapse, thus causing many potential injuries and even deaths. It would be desirable to be able to monitor and detect these deflections to determine when a roof is in danger of collapse.

Devices for measuring deformations in other structures are discussed in the background of U.S. Pat. No. 5,404,132, which is expressly incorporated herein by reference for all purposes.

SUMMARY OF THE INVENTION

The present invention is a system that can detect weight on a building and can provide an early warning of an impending collapse based on an amount of deflection present in the structure, and is particularly suitable for detecting deflections in joists or structural beams of a roof structure.

In a preferred embodiment of the present invention, an energy beam is directed along a path to a receiver that can sense the energy beam. A target is attached to a roof structure and extends downwardly away from the structure so that the target is in or near the path of the beam and can move respectively out of or into the path in response to a deflection. An alarm connected to the receiver is triggered when the receiver changes state with respect to sensing of the beam. Accordingly, the receiver can trigger an alarm when it receives a beam, while not triggering an alarm when it does not receive the beam, or vice versa. The beam is preferably a pulsed infrared beam, the targets are preferably rectangular plates, and the alarm is preferably triggered by an external edge of the target breaking for a sufficient period of time the beam that otherwise contacts the receiver.

The present invention can provide an early warning that allows a building to be evacuated before it collapses, thus possibly saving lives, particularly in warehouses, supermarkets, superstores, and other large structures with flat roofs. Other features and advantages of the present invention will become readily apparent upon further review of the following detailed description and drawings.

DETAILED DESCRIPTION

Figure 1:
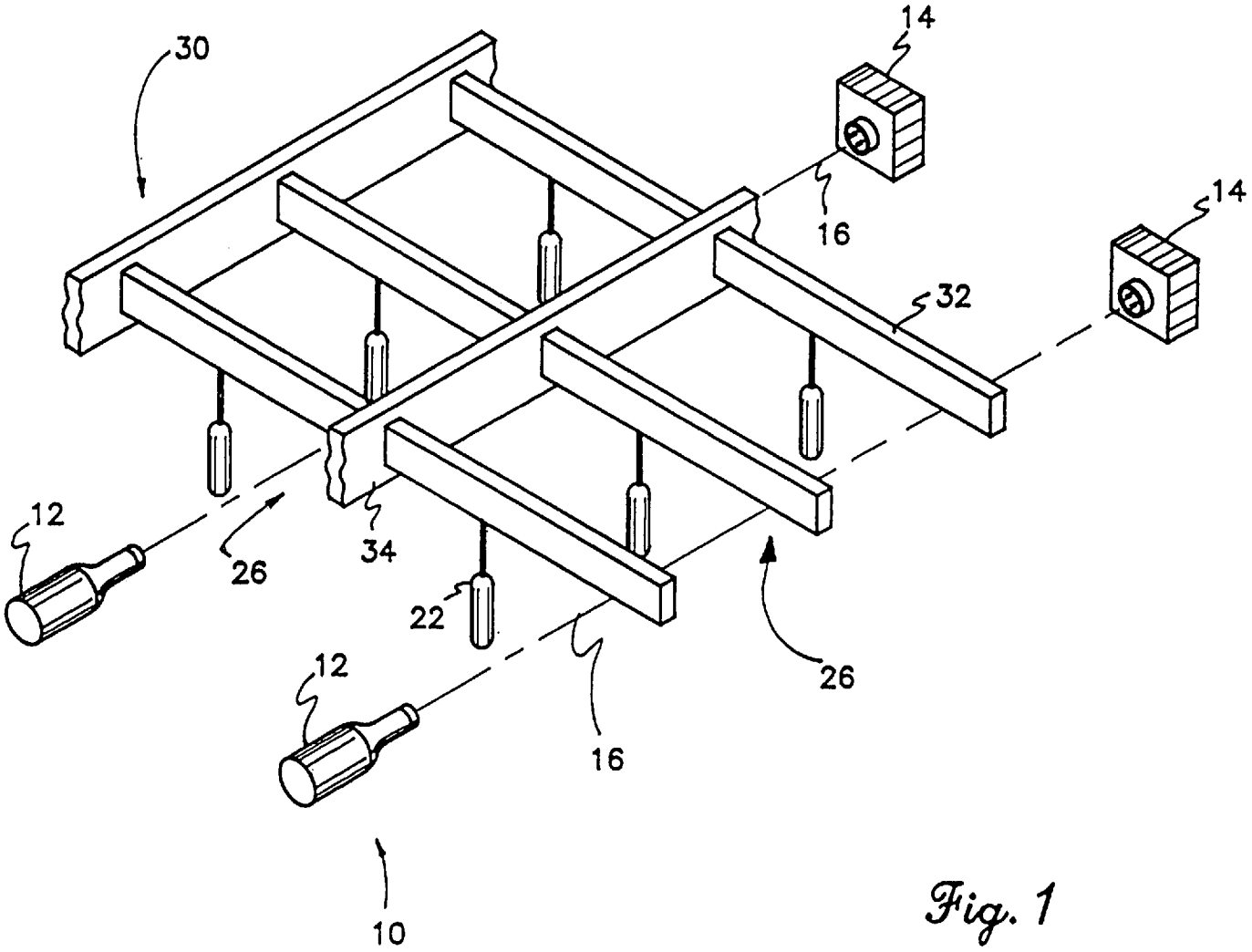
FIG. 1 is a perspective view of an embodiment of a deflection monitoring system according to the present invention.
Figure 2:
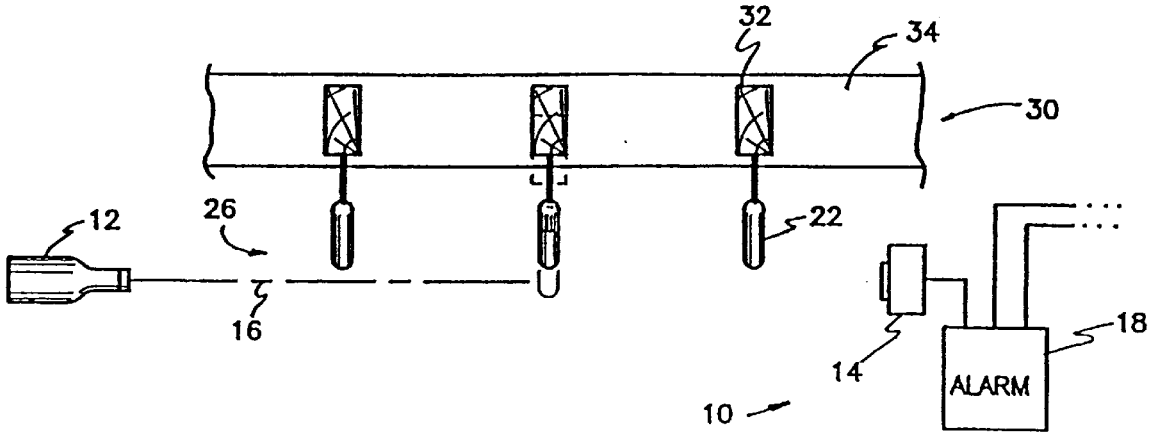
FIG. 2 is a diagrammatic side view of the system of FIG. 1.

Referring to FIGS. 1 and 2, in one embodiment of the present invention, a deflection detection system 10 includes an energy beam source 12, a receiver 14, and a number of target blocks 22. The deflection detection system 10 is preferably used on a roof structure 30.

A plurality of sources 12, such as lasers, visible light sources, or infrared light sources (e.g., R Series low power modulated LED infrared light beam sources available from Autotron) are positioned at regular intervals along a perimeter of structure 30. Sources 12 project beams 16 along a path adjacent to the structure 30. Sources 12 are preferably set in series along a side wall (not shown) at the perimeter of the frame of structure 30 to generate beams 16 along a path perpendicular to a set of joists 32 and parallel to support beams 34.

Each beam 16 is directed towards a receiver 14, such as a type produced by Autotron for use with the exemplary infrared source available from Autotron, which is energized when beam 16 strikes receiver 14. Sources 12 and the corresponding receivers 14 are preferably placed a predetermined distance beneath structure 30 and a distance apart, e.g., on the order of hundreds of feet. The sources and receivers 14 may be placed either along opposite side walls, or on independent support columns that would be unaffected by deflection of structure 30. Preferably, however, they are near opposite side walls and are attached to the roof structure itself. Each beam 16 is set to monitor a predetermined zone 26 along the structure in concert with target blocks 22 (shown in more detail in FIG. 5 below). Each receiver 14 is connected to a central alarm 18 that is activated when one of the receivers 14 loses contact with the beam 16. A time for which the beam must be broken to activate the alarm can be variably set in the receiver, e.g., from about 0–3 minutes in single second increments. Alarm 18 preferably signals which zone 26 contains the deflection based on the outputs from the receivers 14.

Target blocks 22 are attached to the structure and normally are disposed along a plane located between the path of beam 16 and the structure. For roof structure 30, target blocks 22 extend downwardly and define a horizontal plane between the roof structure 30 and the horizontal plane defined by beams 16. Target blocks 22 may be of any suitable size or shape. While block 22 is shown with an ellipsoidal shape, it preferably is rectangular. As shown in FIG. 2, when deflection occurs in the structure 30, the lower edge of target blocks 22 move into the path of beam 16. The corresponding receiver 14 outputs this negative condition to alarm 18.

Figure 3:
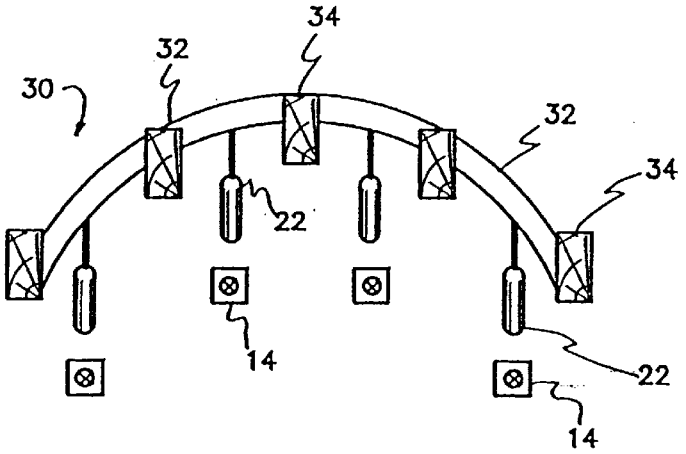
FIG. 3 is a partial elevated view of a second embodiment of the present invention.

As noted above, deflection monitoring system 10 is preferably used to detect deflections in joists 32 of a roof structure 30. Roof structure 30 includes several sets of joists 32, each of which connects two support beams 34 that span the roof. Support beams 34 are preferably I-beams. Joists 32 and beams 34 are often fabricated from structural steel or wood. In FIGS. 1 and 2, joists 32 and beams 34 are depicted as relatively flat structures, but as shown in FIG. 3, the deflection detection system may also be used with crowned structures. FIG. 3 shows that joists 32 may be formed to provide a crowned contour.

A target block 22 is preferably positioned at the center of each joist 32, and extends downwardly below joist 32. For crowned joists, as shown in FIG. 3, a target block 22 is preferably located at the crown of each joist 32. Although target blocks 22 are preferably affixed to joists 32, depending on the construction of the building, target blocks 22 may instead be affixed to support beams 34. Because the structural framing of the building may affect the placement of target blocks 22, the structural frame may also determine the size and quantity of zones 26.

Target blocks 22 normally are positioned over beams 16 and each block occupies an open area between a joist 32 and a beam 16. The distance of target block 22 from beam 16 determines how much deflection in joist 32 must occur before alarm 18 is triggered by receiver 14. The amount of deflection necessary to trigger alarm 18 depends on the load requirements, the modulus of elasticity, and the flexibility of joists 32 and beams 34. These factors may be used to calculate the predetermined distance at which sources 12 and receiver 14 should be place beneath structure 30 and target blocks 22. An exemplary distance is about 1.5 inches for a 40 foot beam 34. Sufficient deflection in any one of joists 32 caused by, for example, a weight overload condition on the roof, will cause target block 22 to be displaced into the path of beam 16, so that an exterior edge of block 22 breaks the beam's contact with receiver 14. Alarm 18 will signal to a central monitoring station which receiver 14 sent the negative signal, and hence identify in which zone 26 the deflection occurred. Alarm 18 could further produce a visual readout of the structure and the deflection zones so that it can be determined which area of the building was being overstressed before it collapses.

Figure 4A:
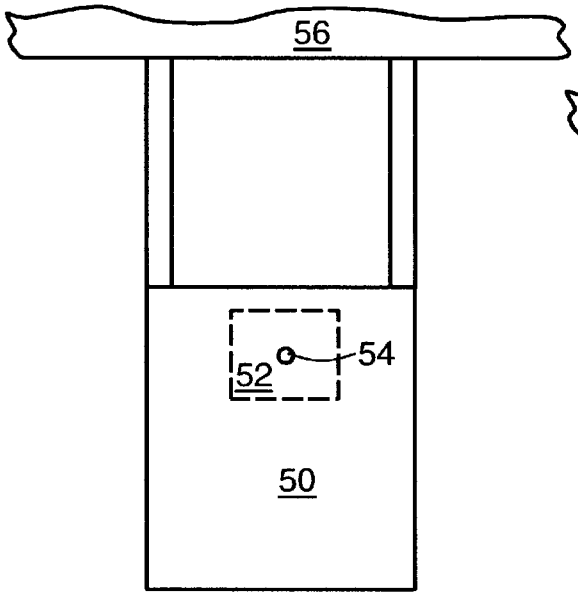
FIG. 4(*a*) and 4(*b*) are pictorial views of a target and receiver according to a third embodiment of the present invention.
Figure 4B:
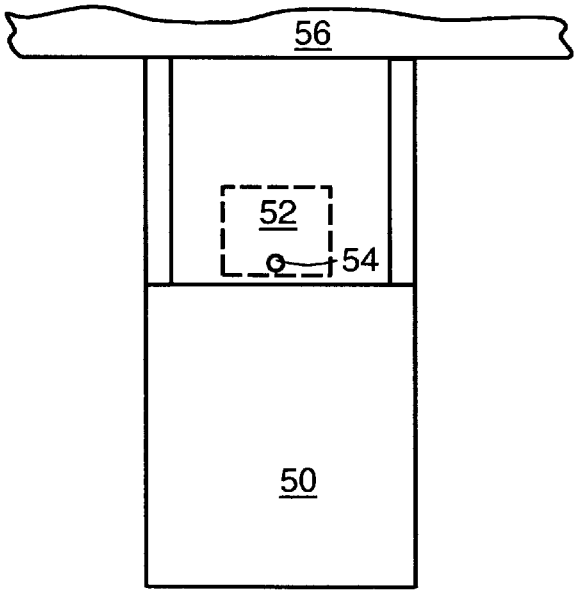

Referring to FIGS. 4(*a*) and 4(*b*), in another embodiment of the present invention, in a first non-deflected state, a source of an energy beam (not shown) provides a beam spot 54 that hits target 50 but not receiver 52 (FIG. 4(*a*)). As in the previous embodiments, target 50 is preferably suspended from a roof structure 56. If roof structure 56 moves downwardly (FIG. 4(*b*)), target 50 also moves downwardly out of the beam path so that beam spot 54 hits receiver 52, thus causing the alarm to be triggered. Accordingly, as in the embodiments of FIGS. 1–2, the receiver has a first state in which it either receives or does not receive the energy beam, and has a second alarm state in which the receiver causes an alarm to be triggered. In the embodiment of FIG. 4, however, the states are reversed from those of the embodiment of FIGS. 1–2.

Figure 5:
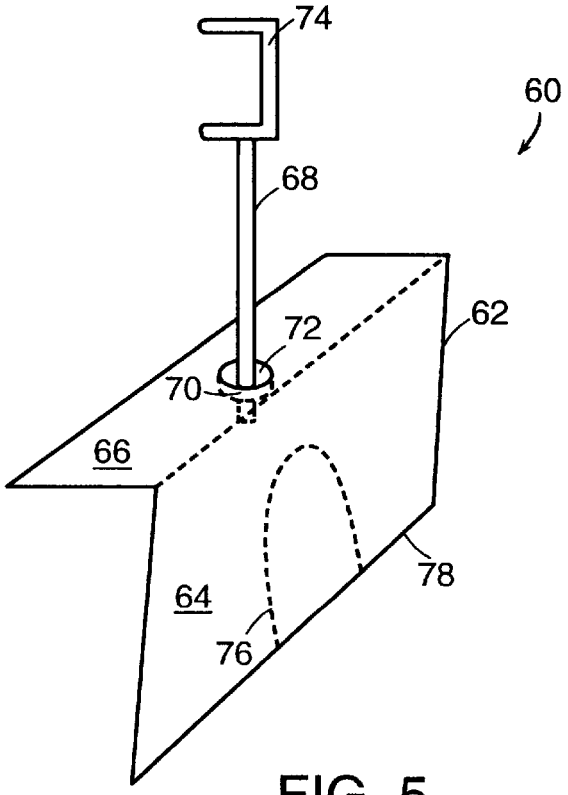
FIG. 5 is a perspective view of a target according to the present invention.

Referring to FIG. 5, an exemplary target 60 has an L-shaped body 62 with a vertical target plate 64 and a horizontal mounting plate 66. Mounting plate 66 has an opening through which a threaded rod 68 is disposed and fastened with two nuts 70, 72, one on either side of plate 66. At the top of rod 68 is a C-clamp 74 that is used to clamp the target overhead to the roof structure. The target here is generally shown as rectangular plate 64, but it may also have a cut-out portion, such as the recess shown by dashed line 76. In either of these embodiments, the target has an outer perimeter with an exterior edge 78 (which edge may include the edge portion defined by dashed line 76) that breaks the beam when it moves into the path.

Figure 6:
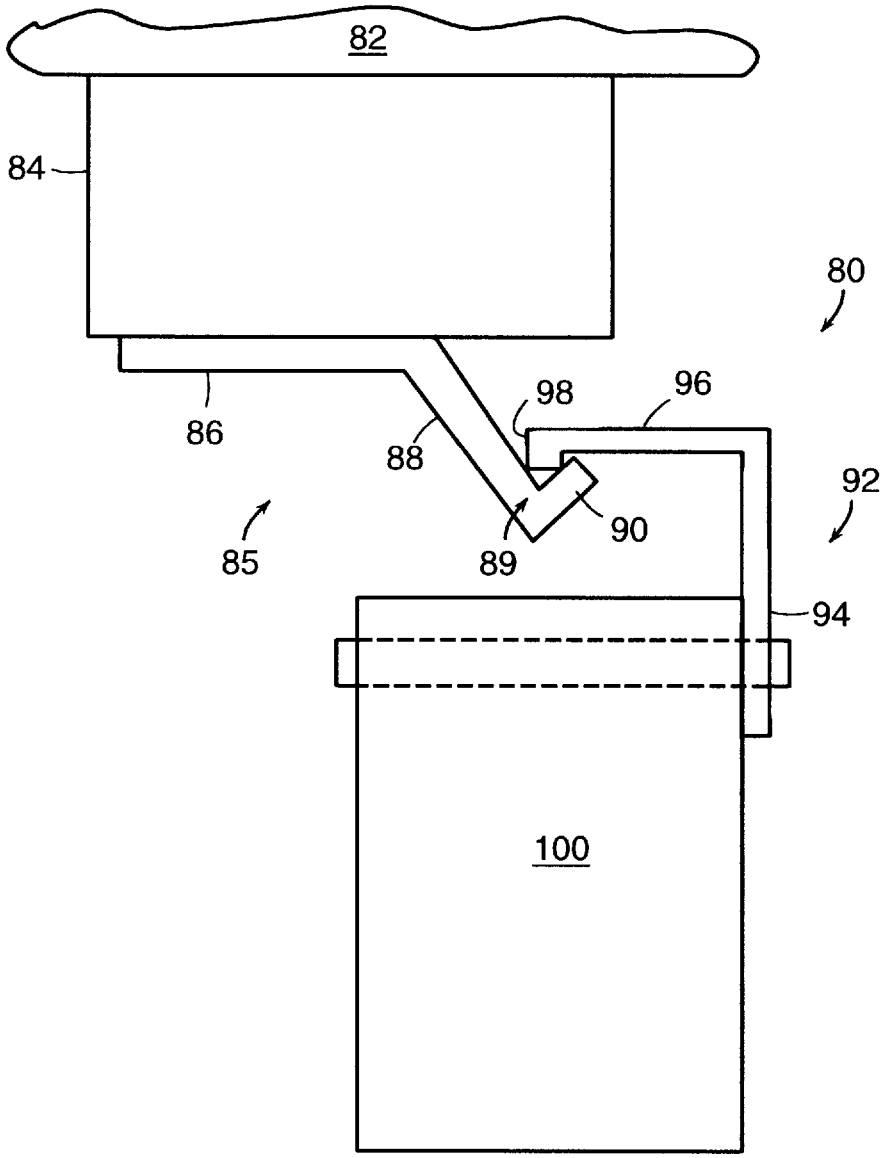
FIG. 6 is an elevational side view illustrating how a transmitter or receiver is mounted to a roof.

Referring to FIG. 6, an exemplary bracket assembly 80 for connecting a receiver and/or a transmitter to a roof structure 82 is shown. The bracket is mounted to a pad 84 and includes a first bracket 85 with a horizontal portion 86 mounted to pad 84, a downwardly angularly extending portion 88, and an upwardly extending portion 90 that forms a V-shaped notch 89 with portion 88. A second bracket piece 92 is generally L-shaped with a vertical portion 94, a horizontal portion 96, and a small flange 98 extending downwardly from portion 96 (parallel to portion 94). Flange 98 extends into V-shape notch 89 formed between portions 88 and 90 of the first bracket. The vertical portion 94 has two openings for receiving threaded rods that extend through transmitter/receiver 100 for holding it to bracket 92. Where flange 98 seats in V-shape notch 89, the connection is not rigid, but rather is held through gravity. This type of connection allows transmitter/receiver 100 to hang vertically and to align itself.

Figure 7:
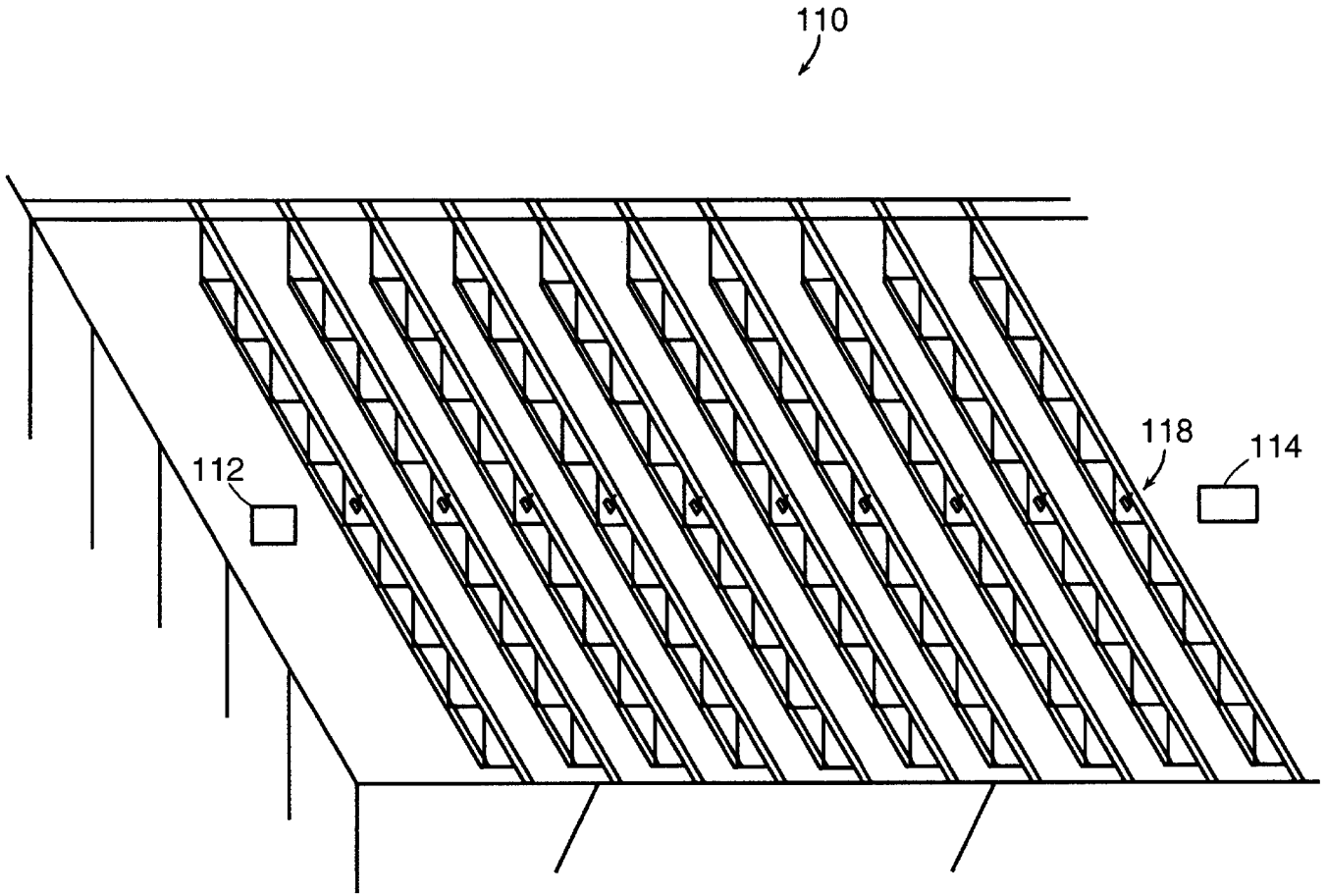
FIG. 7 is a pictorial perspective view illustrating a transmitter, receiver, and targets in a steel roof.

Referring to FIG. 7, in a steel roof structure, an energy source 112 provides a beam 116 to a receiver 114 under a row of targets 118. Each of these targets may be of the type generally shown in FIG. 5, and the energy source and receiver are each preferably held with a bracket such as that shown in FIG. 6. In this steel roof, each section, known as a bay, has one energy source 112, one receiver 114, and a set of targets 118.

The system of the present invention can also sense not only downward deflection in a central portion of the roof, where it can be more susceptible to collapse due to excessive weight, but also kiting, a phenomenon that occurs when ends of a roof billow upwardly. In this case, when a receiver and/or a transmitter are connected to the ends of the roof structure, billowing of the roof ends will result in upward movement of the receiver and/or the transmitter relative to one or more targets, moving the light beam upwardly and causing the target(s) to break the energy beam.

Depending on its sensitivity, the system may also be able to sense deflections caused by individuals on the roof, including potential burglars.

It will be apparent to those skilled in the art that various modifications and variations are possible within the spirit and scope of the present invention. For example, various types of detectable energy beams, such as visible light, laser infrared, or microwave, may be used. A laser or infrared source can be pulsed at a rate that is sufficiently fast to prevent the receiver from sensing a break in the beam. The lasers could also be placed along the horizontal plane of a bridge to detect deflections in the road support structure. Rather than providing a plurality of separate energy sources corresponding to each zone, a single source may be used and split into multiple beams. In the case of a laser, the laser may be optically coupled to a plurality of fiber optic lines, each of which directs a beam to a corresponding receiver, thus avoiding the need for multiple lasers.

What is claimed is:

1. A deflection monitoring system for detecting deflections in a structure, the monitoring system comprising:

an energy source for generating an energy beam along a path near the structure;

a receiver for receiving the energy beam;

at least one solid target attached to and extending downwardly from the structure and located near the path; and an alarm connected to the receiver;

wherein the target is displaceable into the path by a vertical deflection in the structure, the alarm being triggered by the receiver in response to displacement of the target relative to the path.

2. The system of claim 1, wherein the energy source includes a laser.

3. The deflection monitoring system of claim 1, wherein the structure is a roof structure, the system being in combination with the roof structure to provide an early warning of an impending collapse of the roof structure.

4. The system of claim 3, wherein the roof structure is for a building, wherein the energy source, target, and receiver are mounted in the building.

5. The system of claim 1, wherein the energy source includes an infrared source.

6. The system of claim 4, wherein the infrared source is a pulsed infrared source.

7. The system of claim 1, wherein the generating means includes a plurality of sources for generating energy beams.

8. The system of claim 1, wherein the generating means includes a single energy source for generating a single beam and a splitter for dividing the single beam into multiple beams.

9. The system of claim 1, wherein the roof structure is a metal roof with a set of joists connected to support beams of the roof structure, the system further comprising a plurality of targets attached to and extending downwardly from the metal roof structure and being movable in response to a downward deflection of the metal roof structure, the targets being aligned in a row near the path, wherein deflection by any one of the targets can cause the alarm to be triggered by changing the receiver from one of the first and second states to the other of the first and second states, the alarm identifying a region in the roof structure with the deflection.

10. A deflection monitoring system for detecting deflections in a roof structure including a set of joists connected to support beams of the roof structure, the monitoring system comprising:

means for generating a plurality of energy beams along a number of paths, the paths defining zones in the roof structure;

a plurality of receivers, each having a first state in which the receiver receives one of the plurality of energy beams and a second state in which the receiver does not receive one of the energy beams;

an alarm connected to the receivers; and a plurality of targets attached to and extending downwardly from the roof structure and being movable in response to a downward deflection of the roof structure;

wherein any one of the receivers can cause the alarm to be triggered when any one of the receivers changes from one of the first and second states to the other of the first and second states, the alarm identifying the zone in the roof structure with the deflection.

11. The system of claim 10, wherein the generating means includes a plurality of sources for generating energy beams.

12. The system of claim 10, wherein the generating means includes a single energy source for generating a single beam and a splitter for dividing the single beam into multiple beams.

13. The system of claim 12, wherein the single energy source is a laser, and the splitter includes a number of fiber optic lines optically coupled to the laser.

14. The system of claim 12, wherein the single energy source is a laser, and the splitter includes a number of fiber optic lines optically coupled to the laser.

15. The system of claim 10, wherein the paths extend perpendicular to the length of the joists and parallel to the support beams, wherein one the beam traverses one set of the joists.

16. The system of claim 10, wherein the energy source includes a laser.

17. A deflection monitoring system for detecting deflections in a structure, the monitoring system comprising:

an energy source for generating an energy beam along a path near the structure;

a receiver for receiving the energy beam;

a first target extending downwardly from the structure and located near the path, the target including a first piece rigidly connected to the structure, and a second piece that hangs from the first piece such that the hanging of the second piece causes the second piece to align itself relative to the path; and an alarm connected to the receiver;

wherein the target is displaceable into the path by a vertical deflection in the structure, the alarm being triggered by the receiver in response to displacement of the target relative to the path.

18. The system of claim 17, further comprising at least a second target, substantially similar in construction to the first target, the second target also being located near the path.

19. The system of claim 17, wherein the first piece includes a bracket with a V-shaped notch, and the second piece includes an L-shaped bracket with a leg that seats in the notch when the second piece is hung on the first piece.

20. The system of claim 19, further comprising a splitter wherein the energy source provides an energy beam to the splitter, which splits the beam into a plurality of energy beams.

* * * * *